US006814763B2

(12) United States Patent
Bechtold et al.

(10) Patent No.: US 6,814,763 B2
(45) Date of Patent: Nov. 9, 2004

(54) MEDIATOR SYSTEMS BASED ON MIXED METAL COMPLEXES, USED FOR REDUCING DYES

(75) Inventors: Thomas Bechtold, Dornbirn (AT); Stefan Mohr, Wolfurt (AT); Wolfgang Schrott, Böhl-Iggelheim (DE); Norbert Grund, Ludwigshafen (DE); Wolfgang Hiebsch, Lambsheim (DE)

(73) Assignee: DyStar Textilfarben GmbH & Co. Deutschland KG (DE)

( * ) Notice: Subject to any disclaimer, the term of this patent is extended or adjusted under 35 U.S.C. 154(b) by 12 days.

(21) Appl. No.: 10/220,072

(22) PCT Filed: Mar. 1, 2001

(86) PCT No.: PCT/EP01/02308

§ 371 (c)(1),
(2), (4) Date: Oct. 15, 2002

(87) PCT Pub. No.: WO01/65000

PCT Pub. Date: Sep. 7, 2001

(65) Prior Publication Data

US 2003/0121112 A1 Jul. 3, 2003

(30) Foreign Application Priority Data

Mar. 2, 2000 (DE) ..... 100 10 059

(51) Int. Cl.[7] ..... D06P 1/30; D06P 1/22; D06P 1/673

(52) U.S. Cl. ..... 8/599; 8/602; 8/611; 8/594; 8/604; 8/623; 8/650; 8/652; 8/653; 8/918

(58) Field of Search ..... 8/602, 611, 604, 8/623, 594, 599, 650, 652, 653, 918

(56) References Cited

U.S. PATENT DOCUMENTS

| | | | | |
|---|---|---|---|---|
| 5,244,549 | A | 9/1993 | Bechtold | 204/134 |
| 5,443,599 | A | 8/1995 | Bechtold | 8/623 |
| 5,586,992 | A | 12/1996 | Schnitzer et al. | 8/653 |

FOREIGN PATENT DOCUMENTS

| | | |
|---|---|---|
| DE | 42 06 929 | 9/1993 |
| DE | 43 20 866 | 1/1995 |
| DE | 43 20 867 | 1/1995 |
| DE | 199 19 746 | 11/2000 |
| WO | WO 90/15182 | 12/1990 |
| WO | WO 92/09740 | 6/1992 |
| WO | WO 94/23114 | 10/1994 |
| WO | WO 95/07374 | 3/1995 |
| WO | WO 96/32445 | 10/1996 |

*Primary Examiner*—Margaret Einsmann
(74) *Attorney, Agent, or Firm*—Connolly Bove Lodge & Hutz LLP

(57) ABSTRACT

Mediator systems obtainable by mixing one or more salts of a metal capable of forming a plurality of valence states with at least one amino-containing complexing agent (K1) and at least one hydroxyl-containing but amino-devoid complexing agent (K2) in an alkaline aqueous medium, wherefor the complexing agents may be present as salts and the molar ratio of K1 to metal ion is from 0.1:1 to 10:1 and the molar ratio of K2 to metal ion is from 0.1:1 to 5:1 are useful for dyeing cellulosic textile material.

16 Claims, No Drawings

MEDIATOR SYSTEMS BASED ON MIXED METAL COMPLEXES, USED FOR REDUCING DYES

The present invention relates to mediator systems obtainable by mixing one or more salts of a metal capable of forming a plurality of valence states with at least one amino-containing complexing agent (K1) and at least one hydroxyl-containing but amino-devoid complexing agent (K2) in an alkaline aqueous medium, wherefor the complexing agents may be present as salts and the molar ratio of K1 to metal ion is from 0.1:1 to 10:1 and the molar ratio of K2 to metal ion is from 0.1:1 to 5:1.

The invention also provides a process for reducing dyes, a process for dyeing cellulosic textile material using these mediator systems and the cellulosic textile materials dyed by this process.

Vat dyes and sulfur dyes are important classes of textile dyes.

Vat dyes are of major significance for dyeing cellulose fibers on account of the high fastnesses of the dyeings in particular. To use these dyes, the insoluble oxidized dye has to be converted into its alkali-soluble leuco form by a reducing step. This reduced form has high affinity for cellulose fiber, goes onto the fiber and once on the fiber is converted back into its insoluble form by an oxidizing step.

The class of sulfur dyes is particularly important for the production of inexpensive dyeings having average fastness requirements. The use of sulfur dyes likewise involves the need to carry out a reducing step and an oxidizing step in order that the dye may be fixed on the material.

The literature describes a wide range of reducing agents for use on an industrial scale, eg. sodium dithionite, organic sulfinic acids, organic hydroxy compounds such as glucose or hydroxyacetone. In some countries sulfur dyes are still being reduced using sulfides and polysulfides.

A feature common to these reducing agents is the absence of a suitable way for regenerating their reducing effect, so that these chemicals are discharged after use into the wastewater together with the dyebath. As well as the costs for fresh chemicals to be used, this also creates the additional expense of having to treat the wastewaters produced.

Further important disadvantages of these reducing agents are the very limited means to influence their reducing effect or their redox potential under application conditions in the dyebath and the absence of simple control technology for regulating the dyebath potential.

A further group of reducing agents was discovered in the class of iron(II) complexes. Iron(II) complexes are known with triethanolamine (WO-A-90/15182, WO-A-94/23114), with bicine (N,N-bis(2-hydroxyethyl)glycine) (WO-A-95/07374), with triisopropanolamine (WO-A-96/32445) and also with aliphatic hydroxy compounds which may contain a plurality of hydroxyl groups and may additionally be functionalized with aldehyde, keto or carboxyl groups, such as di- and polyalcohols, di- and polyhydroxyaldehydes, di- and polyhydroxyketones, di- and polysaccharides, di- and polyhydroxymono- and -dicarboxylic acids and also hydroxytricarboxylic acids, preference being given to sugar-based compounds, especially the acids and salts thereof, eg. gluconic and heptagluconic acid, and citric acid (DE-A-42 06 929, DE-A-43 20 866, DE-A-43 20 867, prior German patent application DE-A-199 19 746, unpublished at the priority date of the present application, and also WO-A-92/09740).

These iron(II) complexes have a reducing effect which is sufficient for dyeing reduction and which is described by the (negative) redox potential which is measurable in alkaline solution at a certain molar ratio of iron(II):iron(III). Numerous of these iron(II) complexes, eg. the complexes with triethanolamine, bicine, gluconic acid and heptagluconic acid, also have the advantage of being electrochemically regenerable and hence of usefulness as mediators in an electrochemical reduction of dyes and also in electrochemical dyeing processes.

These iron complexes nonetheless have specific weaknesses. For instance, cathodic reduction is possible at high cathodic current density as a diffusion-controlled electrode reaction using triethanolamine or bicine as complexing agent, but the corresponding iron complexes are not sufficiently stable in the more weakly alkaline region at pH $\leqq 11.5$, which greatly limits the usefulness of these complexes as electrochemically regenerable reducing agents in indigo dyebaths for denim manufacture. True, iron complexes with gluconate or heptagluconate are very stable in a pH range of 10–12, but the cathodic current densities obtainable with these complexes leave something to be desired, so that correspondingly larger electrolytic cells have to be used and/or the concentration of iron complex has to be increased, which is disadvantageous for the user with regard to energy requirements, chemical consumption, costs and wastewater loading.

From textil praxis international, 47, pages 44–49 (1992) and Journal of the Society of Dyers and Colourists, 113, pages 135–144 (1997) it is also known to use mixtures of these iron complexes as reducing agents. For instance, the first paper mentioned describes a mixture of iron(II) sulfate, triethanolamine and citric acid in a molar ratio of 1:12.4:0.02 as a reducing agent for the analytical determination of indigo. The latter paper proposes using a mixture of iron(III) sulfate, triethanolamine and sodium gluconate in a molar ratio of 1 (based on iron):6.3:0.04 as a mediator for the electrochemical dyeing with indigo.

But these mixtures too are observed to have the disadvantages associated with the individual complexes, especially the lack of stability at lower pH.

It is an object of the present invention to remedy the disadvantages mentioned and to make it possible to reduce dyes in an advantageous, economical manner.

We have found that this object is achieved by the mediator systems defined at the beginning.

The invention also provides a process for electrochemical reduction of dyes in an alkaline aqueous medium and also a process for dyeing cellulosic textile material with vat dyes or sulfur dyes by electrochemical dye reduction in the presence of metal complexes as mediators, which each comprise using the mediator systems defined at the beginning.

The invention lastly provides cellulosic textile materials which have been dyed by this process.

An essential feature of the mediator systems according to the invention is a combination of the metal ion with the complexing agents K1 and K2 in a molar ratio K1 to metal ion of from 0.1:1 to 10:1, preferably from 0.5:1 to 6:1, and a molar ratio of K2 to metal ion of from 0.1:1 to 5:1, preferably from 0.5:1 to 3:1.

The mediator systems according to the invention are obtainable by mixing the individual components, which may be used in the form of their water-soluble salts, in an alkaline aqueous medium. The metal ion becomes complexed in the process, the prevailing pH, which is generally about 10–14, determining that the particular most favored complex is formed preferentially.

The metal ion M1 can be used not only in low-valent form but also in higher-valent form. For example, in the case of the particularly preferred metal iron, not only iron (II) salts may be used but also iron(III) salts, which are initially readily reduced to iron(II) electrochemically.

Useful amino-containing complexing agents K1 for the invention include in particular aliphatic amines that have at least two coordination-capable groups containing at least one hydroxyl group and that are soluble in water or aqueous organic media or miscible with water or aqueous organic media.

The complexing agents K1 can additionally contain carboxyl groups. Examples of preferred complexing agents K1 are alcoholamines, especially mono-, di- and trialcohol-(especially -alkanol)amines, such as triethanolamine and triisopropanolamine, and also mono-, di- and polyhydroxyaminocarboxylic acids such as N,N-bis(2-hydroxyethyl)glycine. Particularly preferred complexing agents K1 are triisopropanolamine and especially triethanolamine.

It will be appreciated that it is possible to use mixtures of complexing agents K1.

Useful hydroxyl-containing amino-devoid complexing agents K2 for the purposes of the invention include in particular aliphatic hydroxy compounds that have at least two coordination-capable groups and that are likewise soluble in water or aqueous organic media or miscible with water or aqueous organic media and that may contain a plurality of hydroxyl groups and/or aldehyde, keto and/or carboxyl groups. Specific examples of preferred complexing agents K2 are:

- di- and polyalcohols such as ethylene glycol, diethylene glycol, pentaerythritol, 2,5-dihydroxy-1,4-dioxane, especially sugar alcohols such as glycerol, tetritols such as erythritol, pentitols such as xylitol and arabitol, hexitols such as mannitol, dulcitol, sorbitol and galactitol;
- di- and polyhydroxyaldehydes such as glyceraldehyde, triose reductone, especially sugars (aldoses) such as mannose, galactose and glucose;
- di- and polyhydroxyketones such as, in particular, sugars (ketoses) such as fructose;
- di- and polysaccharides such as sucrose, maltose, lactose, cellubiose and molasses;
- di- and polyhydroxymonocarboxylic acids such as glyceric acid, particularly acids derived from sugars, such as gluconic acid, heptagluconic acid, galactonic acid and ascorbic acid;
- di- and polyhydroxydicarboxylic acids such as malic acid, particularly sugar acids such as glucaric acids, mannaric acids and galactaric acid;
- hydroxytricarboxylic acids such as citric acid.

Particularly preferred complexing agents K2 are citric acid and especially the monocarboxylic acids derived from sugars (especially gluconic acid and heptagluconic acid) and their salts, esters and lactones.

It will be appreciated that it is also possible to use mixtures of complexing agents K2. A particularly useful example thereof is a mixture of gluconic acid and heptagluconic acid, preferably in a molar ratio of from 0.1:1 to 10:1, which provides iron complexes that are particularly stable at high temperatures.

In particularly preferred mediator systems according to the invention, wherein the metal ions are iron(II/III)ions, said complexing agent K1 is triethanolamine and said complexing agent K2 is gluconic acid and/or heptagluconic acid.

The particular advantages of the mediator systems according to the invention are that an electrochemical dye reduction can be carried out at low concentration of low-valent metal ion—and hence low concentration of active complex—coupled with high cathodic current density and, at the same time, the complexed system present is stable even at relatively low pH, generally ≦10. Unexpectedly, the attainable current densities and complex stabilities substantially exceed the results expected for a mixture of the two individual systems (metal ion/K1 and metal ion/K2).

This is shown by a comparison with the cathodic peak flows determined for a mediator system composed of iron ions, gluconate ions and triethanolamine at an NaOH concentration of 0.175 mol/l by cyclic voltammetry using a hanging mercury drop electrode and a voltage feed rate of 200 mV/s.

| Measurement No. | Iron mol/l | Gluconate mol/l | Triethanolamine mol/l | pH | Peak potential mV | Cath. peak current mA |
|---|---|---|---|---|---|---|
| 1 | 0.010 | 0.020 | 0.060 | 12.9 | −1010 | 43.0 |
| 2 | 0.010 | 0.020 | 0.030 | 13.1 | −1005 | 43.0 |
| 3 | 0.010 | 0.020 | 0.010 | 12.9 | −1000 | 38.6 |
| 4 | 0.010 | 0.020 | 0.002 | 12.9 | −1000 | 22.4 |
| C1 | 0.010 | — | 0.060 | 12.9 | −1010 | 42.8 |
| C2 | 0.010 | 0.020 | — | 12.9 | −1000 | 5.5 |

The mediator systems of the invention are very useful for the electrochemical reduction of dyes.

The process of the invention is particularly important for reducing vat dyes and sulfur dyes, particularly the class of indigoid dyes, the class of anthraquinonoid dyes, the class of dyes based on highly fused aromatic ring systems and the class of sulfur cooking and baking dyes. Examples of vat dyes are indigo and its bromine derivatives, 5,5'-dibromoindigo and 5,5',7,7'-tetrabromoindigo, and thioindigo, acylamino-anthraquinones, anthraquinoneazoles, anthrimides, anthrimidecarbazoles, phthaloylacridones, benzanthrones and indanthrones and also pyrenequinones, anthanthrones, pyranthrones, acedianthrones and perylene derivatives. Examples of particularly important sulfur dyes are C.I. Sulfur Black 1 and C.I. Leuco Sulfur Black 1 and sulfur vat dyes such as C.I. Vat Blue 43.

The inventive process for reducing the dye customarily employs the mediator in an amount not more than approximately that required by the dye reduction stoichiometry. So one mole of an oxidized dye which takes up two electrons per molecule to convert into the leuco form is generally reckoned, 2 mol of a mediator system according to the invention, based on the redox-active metal ion supplying one electron. It will be appreciated that electrochemical regeneration of the mediator can reduce this mediator quantity (in the case of dyeing with vat dyes generally to about 0.1–1 mol of reduced mediator per mole of dye, based on one liter of dyebath). The greater the deficiency of mediator system, the higher the requirements the electrolytic cell has to meet.

The reduction process of the invention can advantageously be part of the similarly inventive process for dyeing cellulosic textile material with vat and sulfur dyes. Preferably, in this case, the dye is added to the dyebath in prereduced form, for example in the form of an alkaline solution of catalytically reduced indigo, and the portion of the dye that is reoxidized by air contact during dyeing is reduced electrochemically by means of mediator systems according to the invention.

The dyeing itself may be carried out as described in the references cited at the beginning. Any known continuous and batch dyeing methods, for example the exhaust method and the padding method, may be employed.

Because different dyeing processes and dyeing machines differ in the degree of air access they allow, there will be some instances where appreciable quantities of mediator system have to be used to cope with the oxygen from the air. For instance, exhaust dyeing with vat dyes to medium depths of shade will impose an additional requirement of about 1–10 mol of reduced mediator per mole of dye, while continuous dyeing with indigo additionally requires about 2–10 mol of reduced mediator per mole of indigo.

The rest of the process conditions, such as type of textile assistants, use levels, dyeing conditions, type of electrolytic cell and finishing of the dyeings, can be chosen as customary and as described in the references cited at the beginning.

The dyeing process of the invention provides advantageous dyeing on all cellulosic textile materials. Examples are fibers composed of cotton, regenerated cellulose such as viscose and modal and bast fibers such as flax, hemp and jute. Useful processing forms include for example staple, tow; yarn, thread, wovens, drawn-loop knits, formed-loop knits and made-up pieces. Machine forms can be pack systems, hank, package, warp beam, fabric beam and piece goods in rope form or open width.

EXAMPLES

Yarn Dyeing

Example 1

1.8 kg of ready-to-dye pretreated yarn composed of cellulose fibers (medium fineness) on two cross-wound packages were dyed with 18.2 g of Indanthren® Brillant-violett 3B (C.I. Vat Violet 9) in a yarn dyeing apparatus coupled to an electrolytic cell.

The electrolytic cell was a multicathode cell (10 electrodes, planar surface area 0.18 $m^2$, total surface area 4.3 $m^2$). The anolyte used was 2% by weight sodium hydroxide solution (supplemented with 50% by weight sodium hydroxide solution in line with the flowed charge quantity to keep the cell voltage constant). Catholyte (dyebath) and anolyte were kept apart by a cation exchange membrane. The cathode used was a stainless steel mesh, while the anode used was a titanium electrode coated with platinum mixed oxide.

The dyeing was carried out as follows:

| 180 l of a dyebath of the composition | |
|---|---|
| 0.015 mol/l | of iron(III) chloride (40% by weight aqueous solution; 4.3 ml/l) |
| 0.068 mol/l | of triethanolamine (85% by weight aqueous solution; 12 g/l) |
| 0.005 mol/l | of sodium gluconate (99% strength; 1 g/l) |
| 0.37 mol/l | of sodium hydroxide solution (50% by weight aqueous solution; 14.8 g/l) |
| 1 g/l | of a commercially available wetting agent |
| 1.2 g/l | of a commercially available dispersant |
| 0.7 g/l | of a commercially available water-treatment sequestrant |

circulated through the yarn packages (30 l/kg min) and the electrolytic cell (100 l/min) and were reduced prior to the start of dyeing.

Cathodic reduction at a current strength of 45 A was used to initially remove the oxygen from the dyebath. After reaching a potential of −650 mV, the cell current was lowered to about 2 A in order that the dyebath potential may be maintained below the leuco potential of the dye.

After a dyebath temperature of 80° C. had been reached, the dye was added. After a pigmenting time of 10 min at a redox potential of about −700 to −750 mV, the cell current was raised to 9 A in order that the dye may be uniformly converted into its reduced form by indirect electrolysis. In the process, the redox potential rose to −920 mV in the course of 30 min and was then stabilized to a value between −930 and −940 mV by regulation of the cell current. Dyeing was continued under these conditions for a further 30 min. At the same time, the iron(II) complex was continuously regenerated electrochemically.

The dyeing was finished in a conventional manner by oxidizing, rinsing, soaping and neutralizing.

The result of the dyeing was equal in hue, depth of shade and levelness to the result obtained with a conventional reducing agent under identical conditions.

Example 2

3.6 kg of ready-to-dye pretreated yarn composed of cellulose fibers (medium fineness) on four cross-wound packages were dyed with 18.2 g of Indanthren® Brillant-violett 3B (C.I. Vat Violet 9) in the yarn dyeing apparatus of Example 1.

The dyeing was carried out as follows:

| 180 l of a dyebath of the composition | |
|---|---|
| 0.040 mol/l | of iron(III) chloride (40% by weight aqueous solution; 11.5 ml/l) |
| 0.068 mol/l | of triethanolamine (85% by weight aqueous solution; 12 g/l) |
| 0.031 mol/l | of sodium gluconate (99% strength; 6.8 g/l) |
| 0.5 mol/l | of sodium hydroxide solution (50% by weight aqueous solution; 20 g/l) |
| 1 g/l | of a commercially available leveling assistant |
| 1 g/l | of a commercially available wetting agent |
| 1 g/l | of a commercially available dispersant |
| 0.5 g/l | of a commercially available water-treatment sequestrant |

circulated through the yarn packages (30 l/kg min) and the electrolytic cell (100 l/min) and were reduced prior to the start of dyeing.

Cathodic reduction at a current strength of 45 A was used to initially remove the oxygen from the dyebath. After reaching a potential of −700 mV, the cell current was lowered to about 1 A in order that the dyebath potential may be maintained below the leuco potential of the dye.

After a dyebath temperature of 80° C. had been reached, the dye was added. After a pigmenting time of 30 min at a redox potential of about −765 to −780 mV, the cell current was raised to 30 A in order that the dye may be uniformly converted into its reduced form by indirect electrolysis. In the process, the redox potential rose to −920 mV in the course of 20 min and was then stabilized to a value between −930 and −940 mV by regulation of the cell current. Dyeing was continued under these conditions for a further 40 min. At the same time, the iron(II) complex was continuously regenerated electrochemically.

The dyeing was finished in a conventional manner by oxidizing, rinsing, soaping and neutralizing.

The result of the dyeing was equal in hue, depth of shade and levelness to the result obtained with a conventional reducing agent under identical conditions.

Example 3

3.6 kg of ready-to-dye pretreated yarn composed of cellulose fibers (medium fineness) on four cross-wound packages were dyed with a dye mixture composed of 247.1 g of Indanthren Black 5589, 85.3 g of Indanthren Navy G (C.I. Vat Blue 16) 64.9 g of Indanthren Orange RRTS (C.I. Vat Orange 2) and 17.2 g of Indranthen Olivgrün (C.I. Vat Green 3) in the yarn dyeing apparatus as in Example 1.

The dyeing was carried out as follows:

| 180 l of a dyebath of the composition | |
|---|---|
| 0.024 mol/l | of iron(III) chloride (40% by weight aqueous solution; 6.8 ml/l) |
| 0.051 mol/l | of triethanolamine (85% by weight aqueous solution; 9 g/l) |
| 0.017 mol/l | of sodium gluconate (99% strength; 3.7 g/l) |
| 0.34 mol/l | of sodium hydroxide solution (50% by weight aqueous solution; 13.7 g/l) |
| 1 g/l | of a commercially available leveling assistant |
| 1 g/l | of a commercially available wetting agent |
| 1 g/l | of a commercially available dispersant |
| 0.5 g/l | of a commercially available water-treatment sequestrant |

circulated through the yarn packages (30 l/kg min) and the electrolytic cell (100 l/min) and were reduced prior to the start of dyeing.

Cathodic reduction at a current strength of 40 A was used to initially remove the oxygen from the dyebath. After reaching a potential of −670 mV, the cell current was lowered to about 1 A in order that the dyebath potential may be maintained below the leuco potential of the dyes.

After a dyebath temperature of 80° C. had been reached, the dye mixture was added. After a pigmenting time of 30 min at a redox potential of about −765 to −780 mV, the cell current was raised to 40 A in order that the dye may be uniformly converted into its reduced form by indirect electrolysis. In the process, the redox potential rose to −920 mV in the course of 60 min and was then stabilized to a value of −950 mV by keeping the cell current constant. At the same time, the iron(II) complex was continuously regenerated electrochemically.

The dyeing was finished in a conventional manner by oxidizing, rinsing, soaping and neutralizing.

The result of the dyeing was equal in hue, depth of shade and levelness to the result obtained with a conventional reducing agent under identical conditions.

Example 4

1.8 kg of ready-to-dye pretreated yarn composed of cellulose fibers (medium fineness) on two cross-wound packages were dyed with 49.7 g of Indanthren Blue BC (C.I. Vat Blue 6) in the yarn dyeing apparatus as in Example 1.

The dyeing was carried out as follows:

| 180 l of a dyebath of the composition | |
|---|---|
| 0.010 mol/l | of iron(III) chloride (40% by weight aqueous solution; 2.8 ml/l) |
| 0.068 mol/l | of triethanolamine (85% by weight aqueous solution; 12 g/l) |
| 0.005 mol/l | of sodium gluconate (99% strength; |

-continued

| 180 l of a dyebath of the composition | |
|---|---|
| | 1 g/l) |
| 0.37 mol/l | of sodium hydroxide solution (50% by weight aqueous solution; 14.8 g/l) |
| 0.25 g/l | of a commercially available dispersant |

circulated through the yarn packages (30 l/kg min) and the electrolytic cell (100 l/min) and were reduced prior to the start of dyeing.

Cathodic reduction at a current strength of 30 A was used to initially remove the oxygen from the dyebath. After reaching a dyebath temperature of 60° C. and a potential of −910 mV the dye was added over 10 min. In the process, the redox potential was maintained between −910 and −920 mV. After all the dye had been added, the redox potential was stabilized to a value between −930 and −940 mV by regulation of the cell current. Dyeing was continued under these conditions for a further 30 min. At the same time, the iron(II) complex was continuously regenerated electrochemically.

The dyeing was finished in a conventional manner by oxidizing, rinsing, soaping and neutralizing.

The result of the dyeing was equal in hue, depth of shade and levelness to the result obtained with a conventional reducing agent under identical conditions.

What is claimed is:

1. Mediator systems obtainable by mixing one or more salts of a metal capable of forming a plurality of valence states with at least one amino-containing complexing agent (K1) and at least one hydroxyl-containing but amino-devoid complexing agent (K2) in an alkaline aqueous medium, wherefor the complexing agents may be present as salts and the molar ratio of K1 to metal ion is from 0.1:1 to 10:1 and the molar ratio of K2 to metal ion is from 0.1:1 to 5:1.

2. Mediator systems as claimed in claim 1, containing iron(II) ions and/or iron(III) ions.

3. The mediator systems as claimed in claim 1, wherein said complexing agent K1 is an aliphatic amino compound containing at least two coordination-capable groups containing at least one hydroxyl group.

4. The mediator systems as claimed in claim 1, wherein said complexing agent K1 is an alcoholamine.

5. The mediator systems as claimed in claim 1, wherein said complexing agent K2 is an aliphatic hydroxy compound containing at least two coordination-capable groups which optionally contains a plurality of hydroxyl groups and/or aldehyde, keto and/or carboxyl groups.

6. The mediator systems as claimed in claim 1, wherein said complexing agent K2 is a hydroxyl-containing aliphatic carboxylic acid.

7. The mediator systems as claimed in claim 1, wherein the metal ions are iron (II/III) ions, said complexing agent K1 is triethanolamine and said complexing agent K2 is gluconic acid and/or heptagluconic acid.

8. A process for electrochemical reduction of dyes in an alkaline aqueous medium using metal complexes as mediators, which comprises using a mediator system as claimed in claim 1.

9. The process as claimed in claim 8, wherein said dyes are vat dyes or sulfur dyes.

10. The process for dyeing cellulosic textile material with vat dyes or sulfur dyes which comprises an electrochemical dye reduction in the presence of the mediator system as claimed in claim 1.

11. The process as claimed in claim 10, wherein the dye is added to the dyebath in prereduced form and the dye fraction reoxidized during dyeing by air contact is electrochemically reduced by means of the mediator system.

12. Cellulosic textile materials dyed by the process of claim 10.

13. The mediator systems as claimed in claim 2, wherein said complexing agent K1 is an aliphatic amino compound containing at least two coordination-capable groups containing at least one hydroxyl group.

14. The mediator systems as claimed in claim 13, wherein said complexing agent K1 is an alcoholamine.

15. The mediator systems as claimed in claim 13, wherein said complexing agent K2 is an aliphatic hydroxy compound containing at least two coordination-capable groups which optionally contains a plurality of hydroxyl groups and/or aldehyde, keto and/or carboxyl groups.

16. The mediator systems as claimed in claim 14, wherein said complexing agent K2 is a hydroxyl-containing aliphatic carboxylic acid.

* * * * *